US005505597A

United States Patent [19]

White, III

[11] Patent Number: 5,505,597

[45] Date of Patent: Apr. 9, 1996

[54] PRESSURE TOLERANT BALANCED MOTOR VALVE

[75] Inventor: Hollis N. White, III, Hopkinsville, Ky.

[73] Assignee: White Hydraulics, Inc., Hopkinsville, Ky.

[21] Appl. No.: 337,966

[22] Filed: Nov. 14, 1994

Related U.S. Application Data

[63] Continuation of Ser. No. 161,594, Dec. 6, 1993, abandoned.

[51] Int. Cl.[6] ..... F03C 2/08

[52] U.S. Cl. ..... 418/61.3

[58] Field of Search ..... 418/61.3

[56] References Cited

U.S. PATENT DOCUMENTS

| | | | |
|---|---|---|---|
| 3,270,683 | 9/1966 | McDermott | 418/61.3 |
| 3,289,602 | 12/1966 | Hudgens | 418/61.3 |
| 3,309,999 | 3/1967 | Patterson, Jr. | 418/61.3 |
| 3,547,564 | 12/1970 | Charlson | 418/61.3 |
| 3,887,308 | 6/1975 | Liebert | 418/61.3 |
| 4,087,215 | 5/1978 | Miller | 418/61.3 |
| 4,323,335 | 4/1982 | Hansen | 418/61.3 |
| 4,362,479 | 12/1982 | Pahl | 418/61.3 |
| 4,992,034 | 2/1991 | Uppal | 418/61.3 |

*Primary Examiner*—John J. Vrablik
*Attorney, Agent, or Firm*—Lightbody & Lucas

[57] ABSTRACT

A cylindrical valve for a gerotor motor including two alternating series of slots on the outer surface thereof for valving so as to equalize pressure induced dimensional changes for the valve irrespective of motor direction.

18 Claims, 3 Drawing Sheets

PRESSURE TOLERANT BALANCED MOTOR VALVE

This is a continuation application of U.S. Ser. No. 08/161,594 filed Dec. 6, 1993 abandoned.

FIELD OF THE INVENTION

This invention relates to a gerotor device and, more particularly in the preferred embodiment, to a gerotor device having a pressure tolerant balanced motor valve.

BACKGROUND OF THE INVENTION

Cylindrical rotary valves have been utilized in hydraulic devices for years. As long as the application of pressure to such valves is constant and known, a designer can compensate for any pressure induced dimensional changes with relative ease. However, if the pressure is not constant, as in a bidirectional variable speed motor, the pressure induced dimensional changes can create significant loss in the volumetric efficiency, mostly due to increased leakage. This can reek havoc with the design.

OBJECTS AND SUMMARY OF THE INVENTION

It is an object of the present invention to compensate for pressure induced dimensional changes in motor valves.

It is another object of the present invention to increase the volumetric and mechanical efficiency of hydraulic motors.

It is yet another object of the present invention to simplify the design of valves for hydraulic motors.

It is still another object of the present invention to lower the cost of hydraulic devices.

other objects and a more complete understanding of the invention may be had by referring to the following description and drawings in which:

BRIEF DESCRIPTION OF THE DRAWINGS

The structure, operation, and advantages of the presently disclosed preferred embodiment of the invention will become apparent when consideration of the following description taken in conjunction with the accompanying drawings wherein.

DETAILED DESCRIPTION OF THE INVENTION

Figure 1:
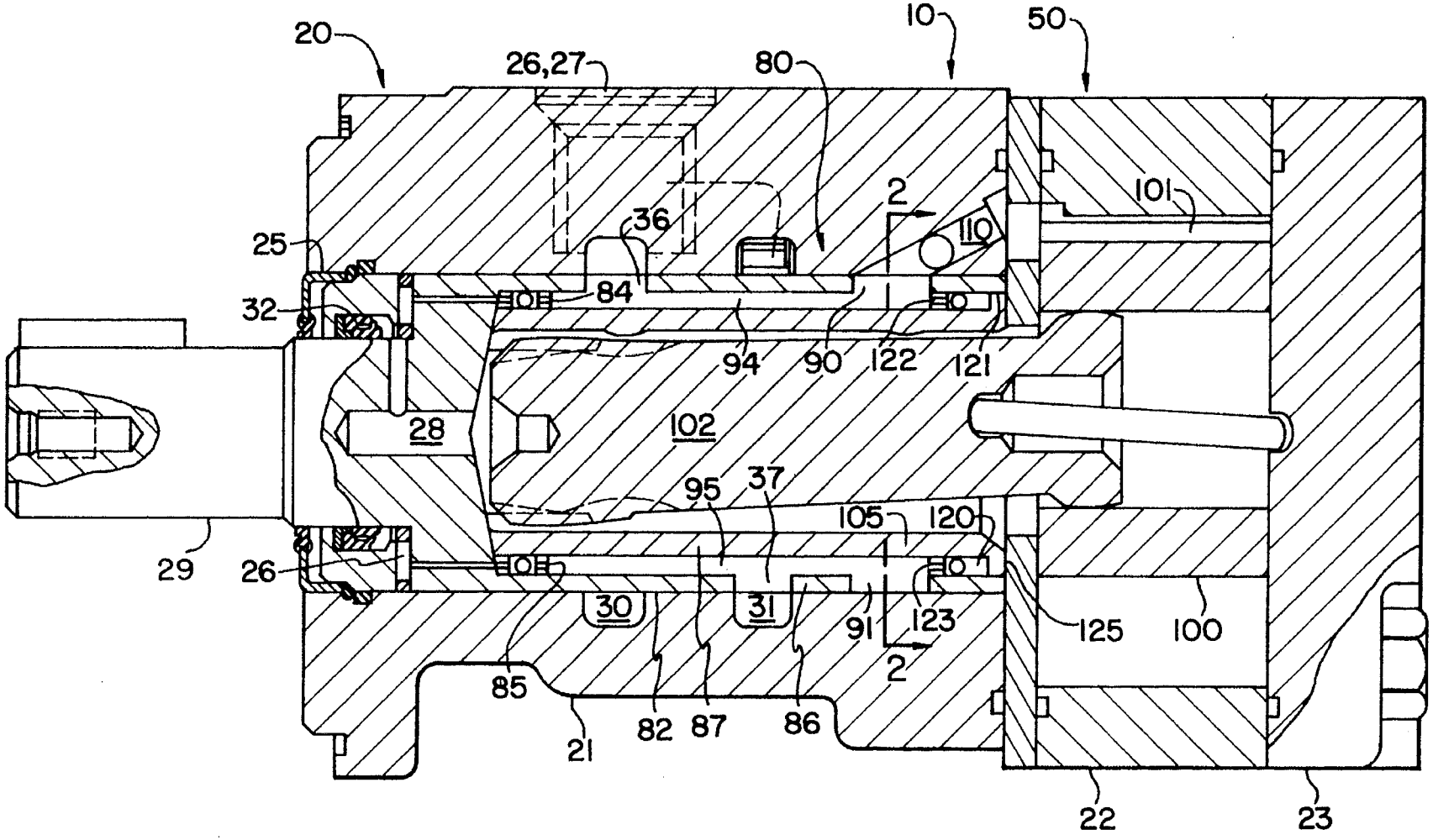
FIG. 1 is a longitudinal cross sectional view of a gerotor motor incorporating the invention of the application.

This invention relates to a cylindrical valve design that automatically compensates for pressure induced dimensional changes.

The invention will be described in its preferred embodiment of a valve for a hydraulic gerotor motor or pump. The particular motor disclosed is White Hydraulics Model RS, disclosed in principle in White U.S. Pat. No. 4,285,643 which is incorporated by reference as typical of the overall design. Its functioning as either a motor or pump depends on the specific mechanical and fluidic connections.

The White RS gerotor motor 10 has a housing 20, a gerotor structure 50, and a drive shaft/cylindrical valve 80.

The housing 20 serves to physically support the later described gerotor structure 50 and shaft 80 as well as containing the fluidic flow passages therefore.

The particular housing 20 disclosed includes a main section 21, a stator 22, and an end cap 23.

The main section 21 includes a central longitudinal cavity 25, two fluid ports 26, 27 and two fluid commutation channels 30, 31.

The longitudinal cavity 25 is for rotatively supporting the shaft 80 to the housing 20. A seal 32 seals the open end of the cavity 25 to the contained shaft 80 so as to eliminate fluidic leakage to the external world. The two fluid communication channels 30, 31 are located on the housing 20 facing the cavity 25 to provide for interconnection of the later described valve 80 to the two fluid ports 26, 27. (The interconnection between port 27 and channel 31 is shown in representational form at 29 in FIGS. 1 and 3.)

The two fluid ports 26, 27 are for interconnecting the motor 10 to a source of pressure and return. Either port 26, 27 can be high pressure or return depending on the particular application.

The stator 22 serves to contain high pressure fluid in the motor 10 as well as aiding to define pressure cells 101 (in conjunction with the rotor 100).

The end cap 23 closes the open end of the pressure cells 101 so as to complete the motor 10.

The drive shaft/cylindrical valve 80 serves a dual purpose of providing a rotational input/output for the motor as well as providing the valving for the motor 10.

The pressure cells 101 between the rotor 100 and the stator 22 are interconnected to the fluid ports 26, 27 through the channels 30, 31, the openings 36, 37, and the slots 90 and 91 respectively and then these selectively through the valving openings 110 in the body 21 of the gerotor motor 20, thus selectively interconnecting the expanding and contracting gerotor cells to the fluid ports 26, 27 to develop the action of the gerotor device.

The output for the motor 10 is accomplished through the mechanical interconnection of the rotor 100 to the shaft 80 (via an intermediate wobblestick 102 in the preferred embodiment disclosed).

The valving for the motor 10 is accomplished by using alternating pressure/return openings on the shaft 80 to cooperate with valving openings 110 in the housing 20 to selectively valve the device.

In the typical White RS motor, the inside opening of the shaft is directly fluidically interconnected to one fluid port. If this inside opening is pressurized, then this pressure (which may be as high as 2000–4000 PSI) causes the shaft to swell, thus increasing its operational diameter. If this inside opening is connected to the return port, then the fluid pressure outside of the shaft can cause the shaft to shrink, thus reducing its operational diameter. Due to this increase/reduction in diameter, the unpressurized static diameter of the shaft must be a compromise allowing either fluid pressurized condition to occur without binding (inside pressurized) or too high fluidic leakage (outside pressurized). This compromise reduces the volumetric efficiency of the motor 10 under most operating conditions. The compromise also increases manufacturing costs by requiring tight tolerances and/or unique part matching. All this is undesirable.

The invention of this present application provides an automatic self compensation means for the circumferential valve 80 irrespective of which port may be pressurized. The invention provides this by providing for the same measure of diameter dimension change for either pressurized condition.

Figure 2:
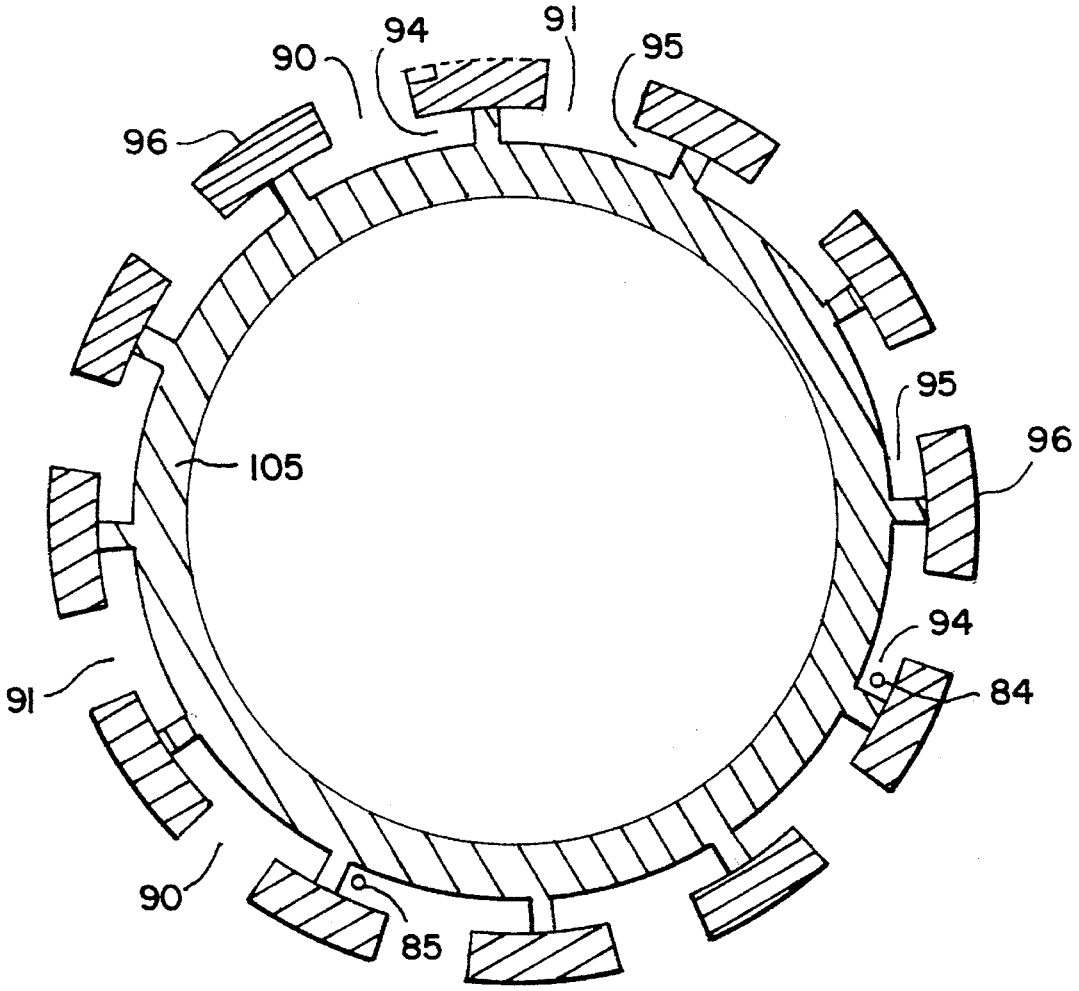
FIG. 2 is a lateral cross sectional view of the valve taken along lines 2—2 of FIG. 1; and, FIG. 3 is a longitudinal cross sectional view like FIG. 1 of an alternate embodiment.

In the preferred embodiment disclosed in FIG. 1-2, this is provided by isolating the inside of the shaft 80 from high pressure fluid in combination with the equalization of pressure forces on the outside of the shaft irrespective of which port is pressurized. The preferred embodiment is provided by isolating the inside area from any non-constant source of pressure, a major cause of pressure induced dimensional changes. In the particular embodiment disclosed, the constant pressure on the inside of the shaft 80 is under the active control of two ball check valves 84, 85 designed to interconnect the inside of the shaft 80 to the return fluid (i.e., lower relative pressure) (high pressure causes the valves 84, 85 to seat). This use increases the control possible by the later described equalization means. It also cools and lubricates the bearings 29 and seals 32. Preferably this interconnection has built in flow restrictions so as to minimize fluidic bypassing of the gerotor cells while also insuring an adequate cooling and lubricating flow. This is due to the inside of the shaft 80 being interconnected to lower relative pressure (i.e., any high pressure fluid anywhere near the head end of the shaft 80 will pass into the inside of the shaft 80 (via passage 28) from the outside, thus passing bearing 29 and seal 32).

In the preferred embodiment disclosed, the isolation of the inside of the shaft 80 is accomplished by using slots 90, 91 along the outside circumference 82 of the shaft 80 for both port commutation.

The equalization of pressure on the shaft 80 is accomplished in the first instance by making the surface area openings of the alternating slots 90, 91 equal and in the second instance by including sub-surface cavities 94, 95 for the slots again equal in cross sectional area. By sub-surface it is meant that cavities 94, 95 have physical section 96 of the shaft 80 radially outward of such cavities in respect to the longitudinal axis of the cylindrical shaft 80.

Due to the alternating slots 90, 91, both equal in surface area and number, no matter which series of slots 90, 91 is pressurized, for any given pressure the same inward collapsing forces will be placed on the shaft 80. This allows a designer to ignore possible pressure expansion of the shaft 80, thus reducing the designer's concern 50% right off the bat.

In addition to the above, the designer, knowing the sizes of the slots 90, 91 and the designed pressure operating range for any particular application of a motor, would be able to calculate the shaft's 80 dimensions and clearance tolerances to optimize the motor's performance for such range. For example as shown in FIG. 1, the thickness 86 of the cylindrical valve 80 radially outside of the equalization cavities 94, 95 is less than the thickness 87 of the cylindrical valve inside of the equalization cavities. Due to the equality of slots 90, 91, possible bidirectional connections can be ignored.

The sub-surface cavities 94, 95 increase this designer's control by maximizing the circumferential area of the shaft 80 that is subject to pressure for a given port connection thus reducing non-linear forces on such shaft 80.

For ease of construction and to better control the pressure induced dimensional changes, a closure part 105 is utilized in the manufacture of the shaft 80 in the preferred embodiment. This closure part 105 allows the sub-surface cavities 94, 95 to be easily milled on the exterior surface of such part 105, with fixed connection (brazing shown at 125) to the shaft 80 completing manufacture. Further by varying the location (inside versus outside the shaft), the materials and/or thickness of the closure part 105 and/or shaft 80, the amount and direction of pressure induced dimensional changes can be controlled. This gives the designer further control on the design.

In order to enhance the operation of the invention, and more particularly to improve sealing between the shaft 80 and the housing 20 at the valving openings, a sealing cavity 120 is included extending circumferentially within the inner end 121 of the shaft 80. Two ball check valves 122, 123 selectively interconnect this sealing cavity 120 to a source of high pressure (via two slots shown). This high pressure in turn expands the surrounding shaft 80 at the root of the valving openings 110, thus better sealing to the surrounding housing at this location.

Figure 3:
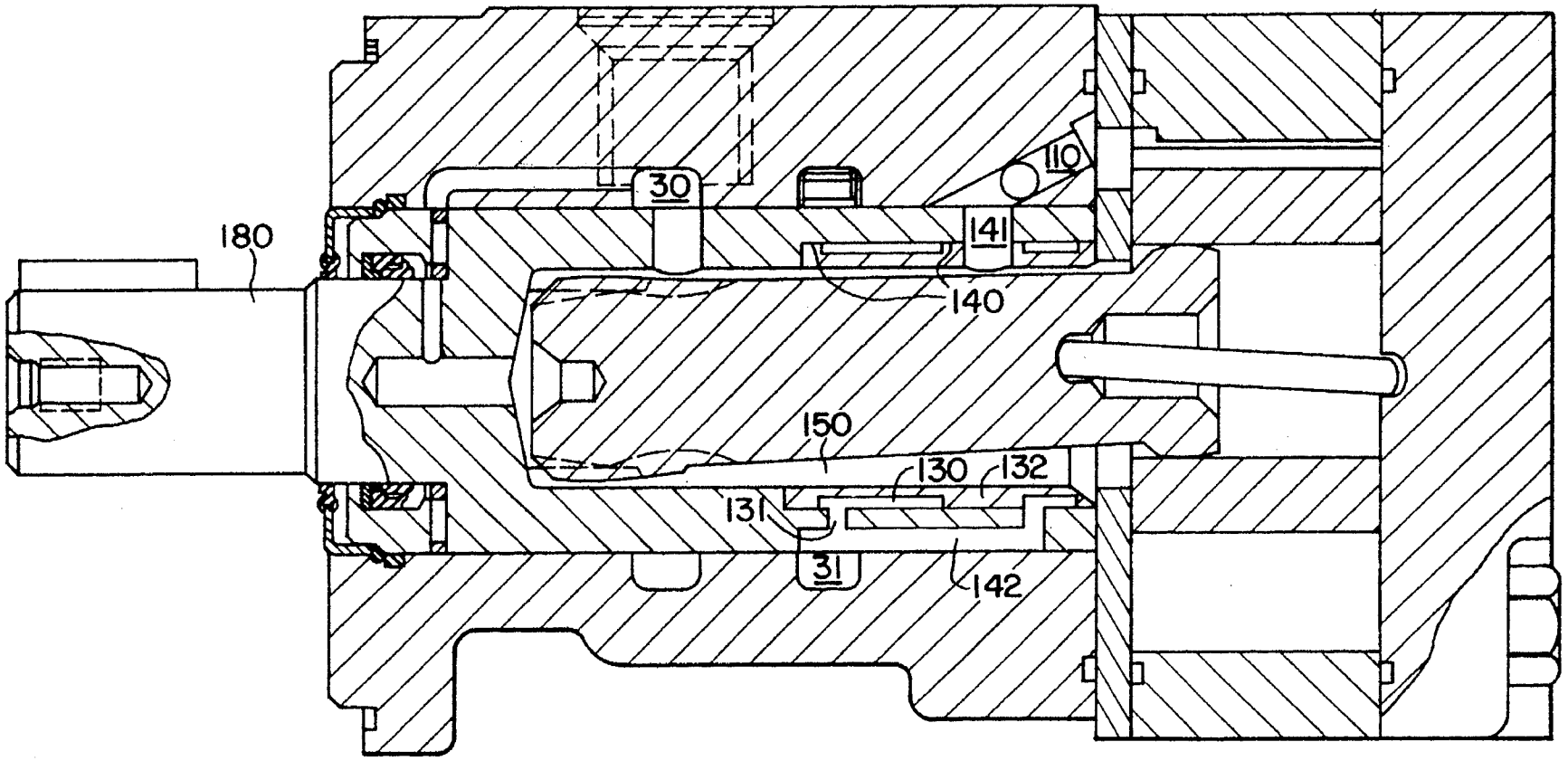

An alternate embodiment of the invention is disclosed in FIG. 3. This device begins generally with the White Model RS, and adds an equalization cavity 130 connected by two holes 131 to the outer surface commutation channel 31. This hole can be anywhere along the circumference of the shaft as long as it extends between the channel 31 and the equalization cavity 130. Note that the device of FIG. 3 utilizes the interior 150 of the shaft 180 to interconnect one channel 30 to the alternating valving opening 110. This is in contrast to the isolation of the interior of the shaft 80 in FIG. 1. An intermediate closure part 132 fixedly connected (again brazing shown at 140) to the inside of the shaft 180 facilitates manufacture.

When the inside of the shaft 180 is pressurized (as would be opening or slot 141), the shaft 180 expands as allowed by the intermediate closure part 132 and surrounding shaft 180.

When the outer surface valving openings or slots 142 are pressurized, so is the equalization cavity 130. This also forces the surrounding shaft 180 to expand.

In both instances, the amount of expansion varies and can be controlled by the thickness and strength of the closure part 132 and shaft 180 together with the relative surface area of the cavities 130, thus allowing a designer to equalize expansion of the shaft 180 for both ports. This technique would also work for devices having valving other than by the shaft.

Although the invention has been described in its preferred embodiment with a certain degree of particularity, it is to be understood that numerous changes can be made without deviating from the invention as hereinafter claimed.

other modifications are also possible.

What is claimed:

1. In a gerotor motor having expanding and contracting pressure cells and a rotating cylindrical valve having an outer surface, circumferentially spaced openings on the outer surface of the cylindrical valve cooperating with valving openings in the housing to selectively interconnect two fluid ports to/from expanding and contracting pressure cells, the improvement comprising the cylindrical valve having a sub-outer surface, first and second sets of cavities, said sets of cavities being in the cylindrical valve, said sets of cavities being alternately circumferentially spaced about the cylindrical valve sub-outer surface thereof with physical sections of the valve being located radially outward thereof in respect to the longitudinal axis of the cylindrical valve, the cavities being fluidically connected to the openings on the outer surface of the valve, and means to fluidically interconnect said first and second sets of cavities to the two ports respectively, said sets of cavities compensating for the physical forces on the valve due to fluidic pressure to provide for substantially equal dimensional change of the outer surface of the rotary valve when either port is pressurized.

2. The improvement of claim 1 wherein the cylindrical valve has an inner opening and characterized by the addition of means to isolate the inner opening from the pressurized fluid.

3. The improved motor of claim 1 wherein the cylindrical valve has longitudinal inner end adjacent the pressure cells and characterized by the addition of a sealing cavity, said sealing cavity being located in the cylindrical valve at the inner end and means to connect said sealing cavity to a source of pressurized fluid.

4. The improvement of claim 1 characterized in that the openings on the outer surface of the cylindrical valve compromise alternating slots, said alternating slots having a surface area respectively, and said surface area of said alternating slots being substantially equal.

5. The improved motor of claim 3 characterized in that said cavities are interconnected to the ports through said slots.

6. The improved motor of claim 3 characterized in that said cavities have a circumferential cross sectional area, and said circumferential cross sectional areas being substantially equal.

7. The improved motor of claim 6 characterized in that said slots have a circumferential surface area on the outer surface of the cylindrical valve and said circumferential cross sectional area of said cavities is greater than said surface area of said slots.

8. The improved motor of claim 3 characterized by the addition of a closure part, said closure part being fixedly connected to the cylindrical valve, and said cavities being located between said closure part and the cylindrical valve.

9. The improved motor of claim 8 wherein the cylindrical valve has an inside and characterized in that said closure part is inserted into the inside of the cylindrical valve.

10. The improved motor of claim 8 characterized in that said closure part has an outer surface and said cavities being formed in said outer surface of the closure part.

11. In a gerotor motor having expanding and contracting pressure cells and a rotating cylindrical valve having an outer surface and a longitudinal axis, circumferentially spaced alternating holes and slots on the outer surface of the cylindrical valve cooperating with valving openings in the housing to selectively interconnect two fluid ports to/from expanding and contracting pressure cells, one port of the two ports being fluidically connected to the inside of the cylindrical valve member, the improvement of equalization means to compensate for the physical forces on the valve due to fluidic pressure to provide for substantially equal dimensional change of the outer surface of the rotary valve when either port is pressurized, and said equalization means includes an equalization cavity, said equalization cavity being located in the cylindrical valve radially spaced from the longitudinal axis thereof, said equalization cavity substantially circumferentially surrounding said holes, and said equalization cavity being fluidically connected to the other of the two ports.

12. The improved motor of claim 11 characterized in that the cylindrical valve has a thickness radially outside of said equalization cavity, the cylindrical valve has a thickness radially inside of said equalization cavity and said thickness of the cylindrical valve radially outside of said equalization cavity is less than said thickness of the cylindrical valve inside of said equalization cavity.

13. The improved motor of claim 11 characterized by the addition of a closure member, said closure member being fixedly connected to the cylindrical valve and said equalization cavity being located between said closure member and the cylindrical valve.

14. The improved motor of claim 13 characterized in that said closure member is located inside of the cylindrical valve.

15. In a gerotor motor having a rotating cylindrical valve having an outer surface, openings on the outer surface of the cylindrical valve cooperating with valving openings in the housing to selectively interconnect two fluid ports to/from expanding and contacting pressure cells of an associated gerotor structure, the improvement of equalization means to compensate for the physical forces on the valve due to fluidic pressure to provide for substantially equal dimensional change of the outer surface of the rotary valve when either port is pressurized, said equalization means including an equalization cavity within the cylindrical valve, said equalization cavity being interconnected to one of the two fluid ports, means for the pressurization of said equalization cavity to force the valve to expand, the cylindrical valve having an opening radially inside the outer surface of the cylindrical valve, and said radially inside opening of the cylindrical valve being interconnected to the other of the two fluid ports.

16. The improvement of claim 15 wherein the cylindrical valve has a longitudinal axis and characterized in that said equalization cavity is spaced further out from the longitudinal axis of the cylindrical valve than the radially inside opening of the cylindrical valve.

17. In a gerotor motor having expanding and contracting pressure cells and a rotating cylindrical valve having a substantially cylindrical outer surface, circumferentially spaced openings on the outer surface of the cylindrical valve cooperating with valving openings in the housing to selectively interconnect two fluid ports to/from expanding and contacting pressure cells, each of the spaced openings extending for a certain distance about the circumference of the valve, the improvement comprising the cylindrical valve having a sub-outer surface, first and second sets of cavities, said sets of cavities being in the cylindrical valve, said sets of cavities being alternately circumferentially spaced about the cylindrical valve sub-outer surface thereof, each of said spaced cavities extending for a certain distance in a direction generally circumferentially of the valve, said certain distance of each of said cavities being greater than the certain distance of each of the spaced openings, and means to fluidically interconnect said first and second sets of cavities to the two ports respectively, the cavities being fluidically connected to the openings on the outer surface of the valve, said sets of cavities compensating for the physical forces on the valve due to fluidic pressure to provide for substantially equal dimensional change of the outer surface of the rotary valve when either port is pressurized.

18. In a gerotor motor having expanding and contracting pressure cells, a rotating cylindrical valve having an outer surface, openings on the outer surface of the cylindrical valve cooperating with valving openings in the housing radially outward of the outer surface of the cylindrical valve to selectively interconnect two fluid ports to/from expanding and contracting pressure cells, the improvement of equalization means to compensate for the physical forces on the valve due to fluidic pressure to provide for substantially equal dimensional change of the outer surface of the rotary valve when either port is pressurized, said equalization means including the openings on the outer surface of the cylindrical valve alternating circumferentially spaced about the circumference of the cylindrical valve, the cavities being fluidically connected to the openings on the outer surface of the valve, said circumferentially alternating openings including a first set of openings have two ends in respect to the axial length of the cylindrical valve, a second set of openings having two ends in respect to the axial length of the cylindrical valve, and the axial location of said ends of said first set of openings and said second set of openings being substantially coextensive with each other in respect to the axial length of the cylindrical valve.

* * * * *